US009380849B2

(12) United States Patent
Domizi

(10) Patent No.: US 9,380,849 B2
(45) Date of Patent: Jul. 5, 2016

(54) HEAD COVER HAVING SELECTABLE SIZE AND LOCATION OF OPENING FOR EXPOSURE OF A PORTION OF A USER'S HAIR

(71) Applicant: Amy Lyn Domizi, Boca Raton, FL (US)

(72) Inventor: Amy Lyn Domizi, Boca Raton, FL (US)

( * ) Notice: Subject to any disclaimer, the term of this patent is extended or adjusted under 35 U.S.C. 154(b) by 0 days.

(21) Appl. No.: 14/305,284

(22) Filed: Jun. 16, 2014

(65) Prior Publication Data

US 2014/0366911 A1 Dec. 18, 2014

Related U.S. Application Data

(60) Provisional application No. 61/834,901, filed on Jun. 14, 2013.

(51) Int. Cl.
*A45D 19/18* (2006.01)

(52) U.S. Cl.
CPC ..... *A45D 19/18* (2013.01)

(58) Field of Classification Search
CPC ..... A45D 19/18; A45D 19/14; A45D 20/18; A42B 1/22; A42B 1/043; A42B 1/061; A42C 5/04
See application file for complete search history.

(56) References Cited

U.S. PATENT DOCUMENTS

| | | | | |
|---|---|---|---|---|
| 2,106,571 | A * | 1/1938 | Lipton | A42B 1/22 2/171.5 |
| 2,730,720 | A | 1/1956 | Saunders | |
| 3,019,444 | A | 2/1962 | Pollack et al. | |
| 3,247,521 | A | 4/1966 | Owen | |
| 3,394,406 | A | 7/1968 | Bergens | |
| 3,929,143 | A * | 12/1975 | Coleman | A42B 1/041 132/243 |
| 5,203,358 | A * | 4/1993 | Eytcheson | A45D 2/46 132/212 |
| 5,249,308 | A | 10/1993 | Blume | |
| 5,978,967 | A | 11/1999 | Williams | |
| 6,134,716 | A | 10/2000 | Richardson | |
| 6,820,283 | B2 | 11/2004 | Graneto, III | |
| 7,096,510 | B2 | 8/2006 | Yeadon | |
| D635,295 | S | 3/2011 | Oswalt et al. | |
| 2013/0298929 | A1 | 11/2013 | Cole | |
| 2014/0101821 | A1 | 4/2014 | Dammann et al. | |

* cited by examiner

*Primary Examiner* — Rachel Steitz

(74) *Attorney, Agent, or Firm* — Fleit Gibbons Gutman Bongini & Bianco PL; Jose Gutman

(57) ABSTRACT

A head cover (800) has selectable size and location of at least one opening (812, 814) for exposure of a portion of a user's hair to an external hair treatment environment. The cover includes an impermeable outer surface that protects hair thereunder from an external hair treatment environment. A main opening (802) in the cover receives a user's head inserted into the cover. An opening (812, 814) on the cover, separate from the main opening, has an opening size selectable from selectable sizes and has an opening location selectable from selectable locations on the protective head cover. The opening (812, 814) selectively exposes a portion of the user's hair from under the cover to an external hair treatment environment while the cover protecting another portion of the user's hair from the external hair treatment environment.

15 Claims, 7 Drawing Sheets

HEAD COVER HAVING SELECTABLE SIZE AND LOCATION OF OPENING FOR EXPOSURE OF A PORTION OF A USER'S HAIR

CROSS-REFERENCE TO RELATED APPLICATION

This application is based upon and claims priority to U.S. Provisional Patent Application Ser. No. 61/834,901, filed on Jun. 14, 2013, the disclosure of which is hereby incorporated by reference in its entirety.

FIELD OF THE DISCLOSURE

The present disclosure generally relates to headwear and head coverings, and more particularly to a head cover that has one or more openings for exposure of a portion of a user's hair outside the head cover.

BACKGROUND

Washing or treatment of a person's hair on their head is a common ritual. Under certain conditions, it is necessary to avoid exposing one's hair to washing or treatment. In such a case, a head covering or cap typically covers most or all of the person's hair to protect it from exposure to the washing or treatment.

For example, a shower cap is commonly used by person's bathing or showering to avoid wetting and washing one's hair. Busy career women and working moms, for example, don't always have the extra time every day for daily washing, shampooing, blow drying, and styling, their hair, which can be an arduous and time consuming collection of tasks in today's fast paced world.

As another example, styling salons may have professional stylists or colorists that provide treatment to a client's hair as a service. A stylist or colorist, for example, will cover a portion of a person's hair on their head, while exposing another portion thereof to treatments such as coloring or special conditioning. The person may be asked to wear a head cover that includes many small openings that are of fixed size and fixed location on the head cover, and through which the person's hair is pulled out and exposed outside of the head cover. The exposed hair is treated while the covered hair is protected from treatment.

There has not been an easy way for a person to select a portion of the person's hair on their head to be washed, shampooed, or treated, without getting adjacent sections of the person's hair wet and exposed to shampoo and other treatments.

BRIEF DESCRIPTION OF THE DRAWINGS

The accompanying figures in which like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

As required, detailed embodiments are disclosed herein; however, it is to be understood that the disclosed embodiments are merely examples and that the devices, systems and methods described herein can be embodied in various forms. Therefore, specific structural and functional details disclosed herein are not to be interpreted as limiting, but merely as a basis for the claims and as a representative basis for teaching one of ordinary skill in the art to variously employ the disclosed subject matter in virtually any appropriately detailed structure and function. Further, the terms and phrases used herein are not intended to be limiting, but rather, to provide an understandable description. Additionally, unless otherwise specifically expressed or clearly understood from the context of use, a term as used herein describes the singular and/or the plural of that term.

The terms "a" or "an", as used herein, are defined as one or more than one. The term "plurality", as used herein, is defined as two or more than two. The term "another", as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes a structural feature that is adapted to, set up, arranged, commanded, altered, modified, built, composed, constructed, designed, or that has any combination of these characteristics to carry out a given function. The term "adapted to" describes structural feature that is capable of, able to accommodate, to make, or that is suitable to carry out a given function.

According to various embodiments of the present disclosure, a hair cover or cap includes one or more openings that each can be selectively sized and selectively located on the cover by a user of the head cover. In this way, for example, the user can select what portion of their hair to expose outside of the hair cover and what other portion of their hair to remain protected under the hair cover. These and other features of the new and novel head cover, according to the present disclosure, will be discussed in more detail below.

Figure 1:
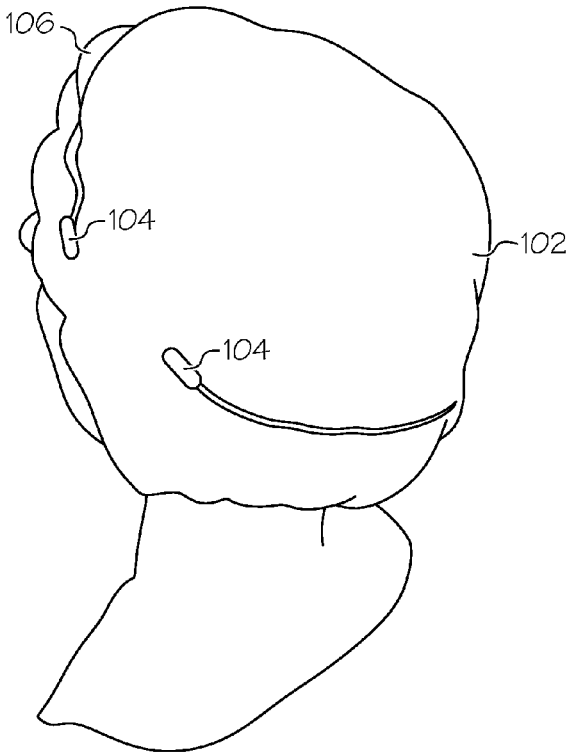
FIG. 1 is a perspective rear view of an example of a shower cap, according to the present disclosure.
Figure 2:
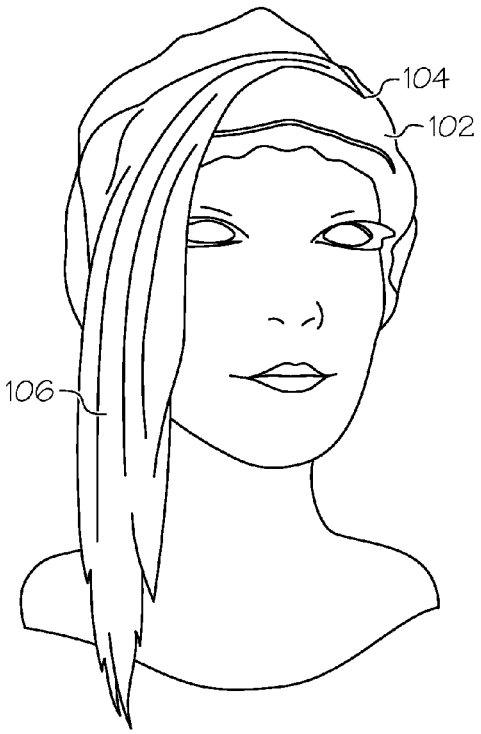
FIG. 2 is a perspective front view of the example shower cap of FIG. 1.
Figure 3:
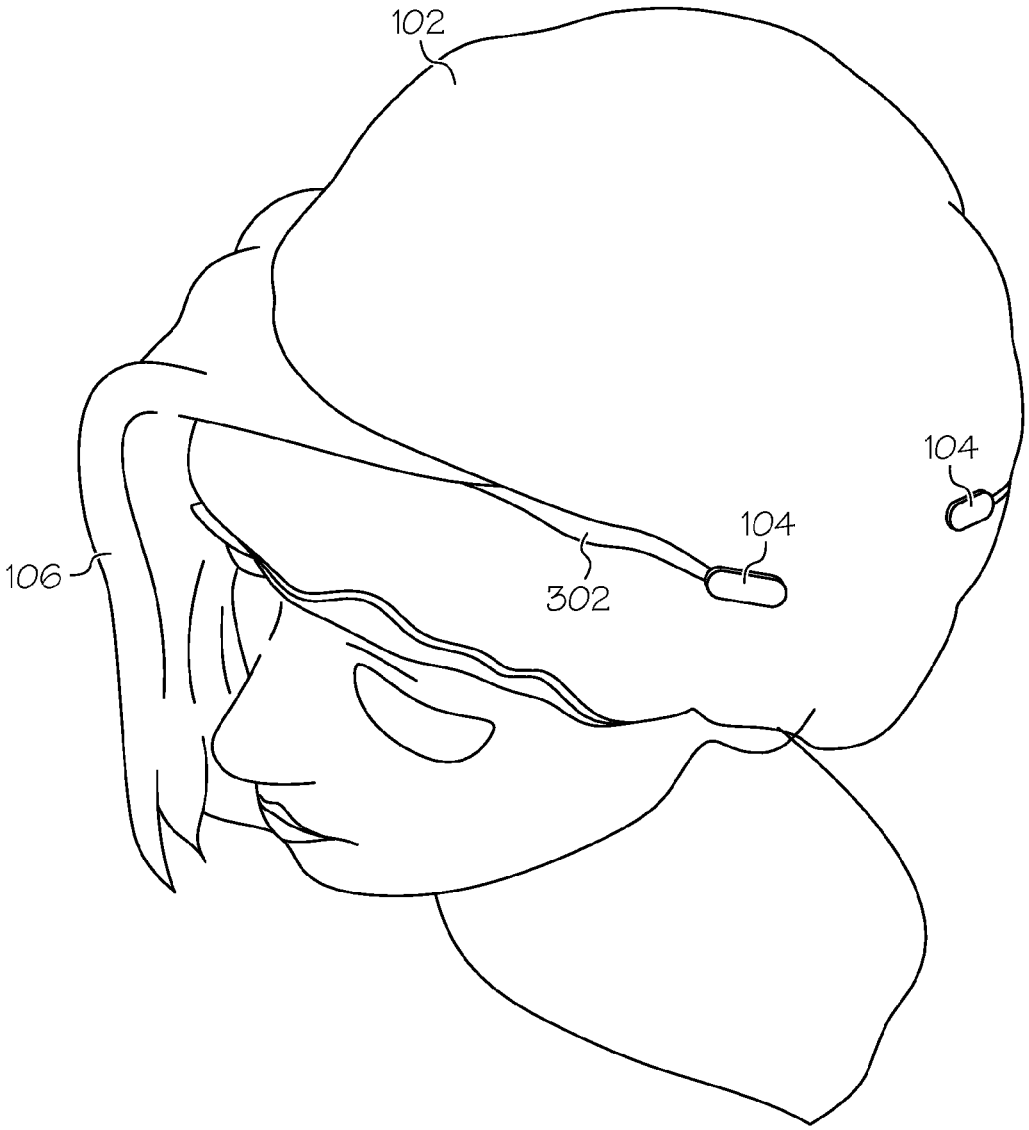
FIG. 3 is a perspective top front view of the example shower cap of FIG. 1.

As shown in FIGS. 1, 2, and 3, a hair protection cover (also referred to as "cover", "head cover", "protective cover", "cap", or the like) 102 is placed on a person's head. The hair protection cover 102 protects at least a portion of the person's hair 106 (i.e., the hair potion under the cover 102) from being exposed to an external hair treatment environment. The external hair treatment environment may include, but is not limited to, any one or more of a shower, a bathing tub, a washing basin, a hair coloring treatment, a hair styling treatment, a medical or hospital personal hair washing or treatment procedure, a nursing home or other personal care giving environment where a patient's or resident's hair is washed, treated, and the like. The head cover 102 typically comprises impermeable material (at least at an outer surface of the head cover 102) that protects the portion of the hair under the cover 102 from exposure to the external hair treatment environment. As an example, and not for limitation, the impermerable material may comprise at least one of: plastic film, nylon, vinyl, and the like.

The hair protection cover 102 can be secured to the person's head by a cover fastening mechanism, such as a head band or an elastic band surrounding at least a portion of a perimeter of a main opening in the protective head cover 102 through which the person's head is inserted. The elastic band would hold the perimeter of the main opening secured to the person's head when the cover 102 is worn on the user's head. The hair protection cover 102 could be secured to the person's head using many different alternative cover fastening mechanisms. For example, the hair protection cover 102 could be secured to the person's head by tying around the person's head a strap that is attached to the perimeter of the main opening of the cover 102.

According to the example shown in FIGS. 1, 2, and 3, the cover 102 includes at least one zipper 104 that extends generally in a horizontal orientation around at least a portion of the user's head when the cover 102 is worn on the user's head. In the example shown in FIGS. 1, 2, and 3, the zipper 104 extends from a location on the front of the cover 102 to a location on the rear of the cover 102 along a generally horizontal circular path as shown. A zipper may follow many different paths on a cover 102 according to various embodiments of the present disclosure. For example, a zipper may only extend along a short path horizontally across a portion of the cover 102. In the example of FIGS. 1, 2, and 3, the zipper 104 is shown partially open from a left starting location on the front of the cover 102 to a right location on the cover 102, creating an opening 302, separate from the main opening, that allows the user's hair 106 to be partially exposed outside of the cover 102 as shown.

Figure 4:
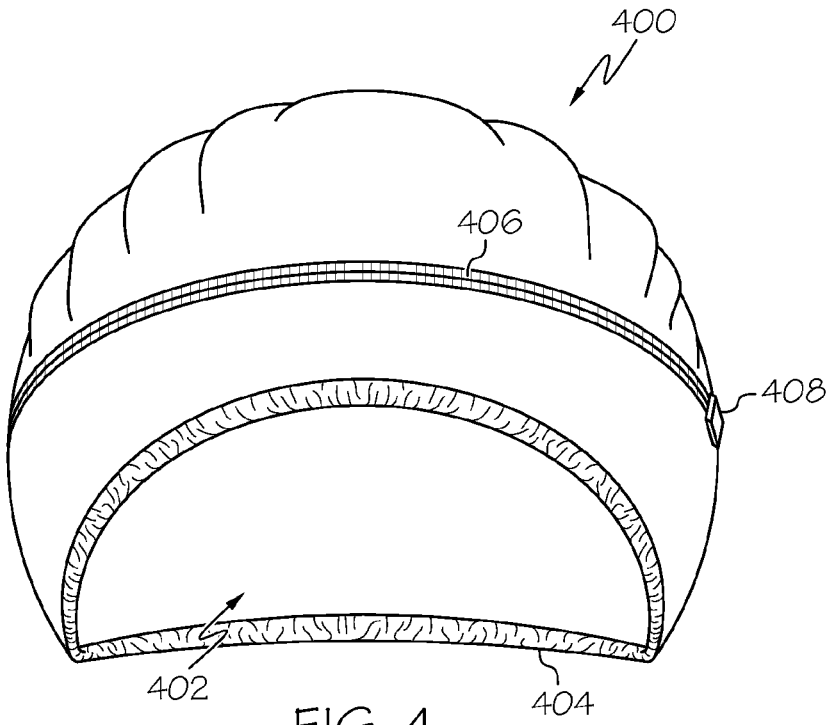
FIG. 4 is a front view of an example of a shower cap, according to the present disclosure.
Figure 5:
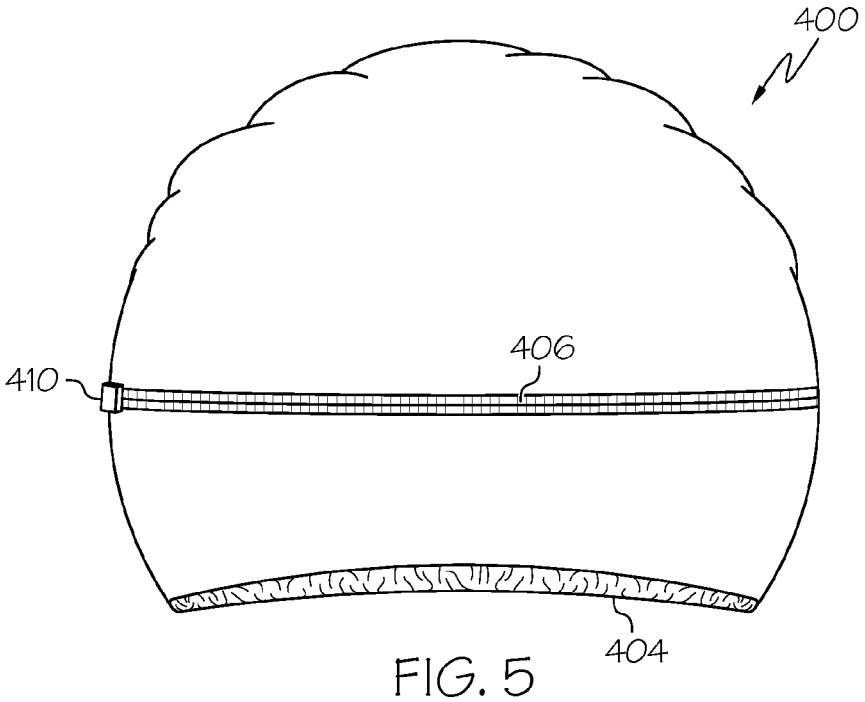
FIG. 5 is a rear view of the example shower cap of FIG. 4.

FIGS. 4 and 5 illustrate a cover 400 with a main opening 402 through which a user's head can be inserted to secure the cover 400 on the user's head when the cover is worn on the user's head. FIG. 4 shows a front view and FIG. 5 shows a corresponding rear view of the same cover 400. In this example, a fastening mechanism comprises an elastic band 404 surrounding the main opening 402.

In this example, a zipper 406 extends generally horizontally around the cover 404 to nearly a full circumference as shown. It should be noted that this path for the zipper 406 is only one example, and that according to various embodiments the zipper 406 could extend along any desired path and for any desired length on a cover 400. FIG. 4 illustrates the zipper 406 extending generally horizontally across the front of the cover 400 just above where would be located a person's forehead and near the hairline on the head while the cover 404 is secured on the person's head. FIG. 5 shows the zipper 406 extending generally horizontally across the rear of the cover 400 where would be located the back of the person's head while the cover 404 is secured on the person's head.

The zipper 406, according to the present example, comprises nylon plastic or polymer material. Many or all of the zipper components 406 can be made of various types of plastic or polymer materials. Of course, in alternative embodiments one or more zippers, or a component thereof, can be made of any one or a combination of materials such as metal, nylon, plastic, polymer, ceramic, and other suitable materials, that can be matched to particular applications of the head cover 404.

The zipper 406, in the example shown in FIGS. 4 and 5, extends from a first zipper stop 408, located toward the front of the cover 400, to a second zipper stop 410, located toward the rear of the cover 400. According to various embodiments of the present disclosure, the zipper 406 may include at least one zipper slider mechanism that causes the zipper 406 to close into a zipper chain with zipper slider movement in a first direction along the zipper 406 and alternatively causes the zipper 406 to open into two separate rows of zipper teeth with zipper slider movement in a second opposite direction along the zipper 406. The opening of the zipper 406 also creates an opening in the cover 400. This opening can be selectively sized from a plurality of selectable sizes and selectively located from a plurality of selectable locations on the cover 400 to meet the requirements of a user of the cover 400. It should be noted that the cover 400, according to various embodiments, can be rotated on a person's head to selectively locate the created opening on a particularly desired portion of hair on the user's head. In this way, a portion of user's hair may be selectively exposed, through the created opening in the cover 400, to an external hair treatment environment.

Figure 6:
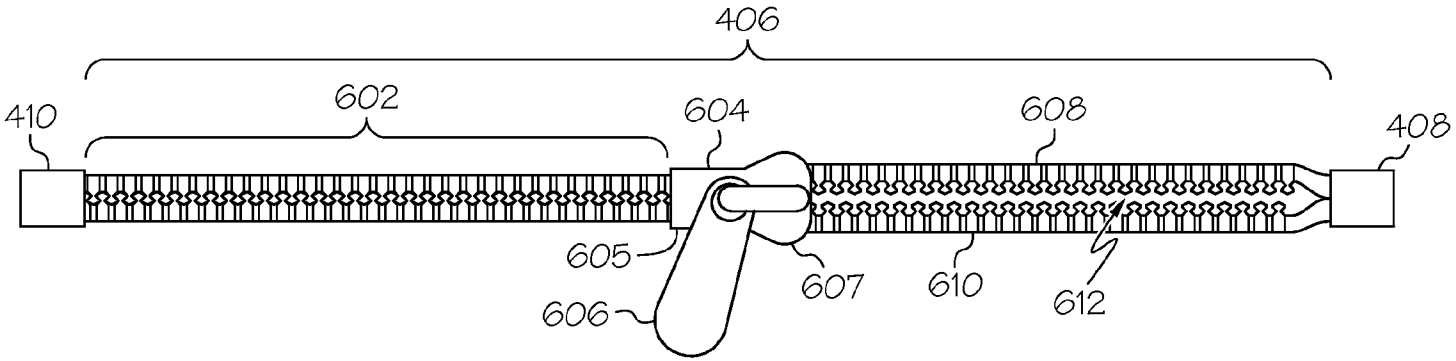
FIG. 6 is an illustration of a first example of a zipper, suitable for use with an embodiment according to the present disclosure.

An example of this type of zipper slider mechanism is illustrated in FIG. 6. The zipper 406 is shown with a single zipper slider 604. The zipper slider 604 internally includes a "Y" shaped channel that as the slider 604 is moved along the zipper 406 it can either mesh together (into a chain 602) or separate (leaving an opening 612) opposing rows of teeth 608, 610 in the zipper 406. The zipper slider 604 includes a head 607 and a tail 605. The tail 605 is directed toward the zipper chain 602 while the head 607 is directed to the separated opposing rows of teeth 608, 610 in the zipper 406.

It should be noted that certain zipper sliders are manually locking and some are automatically locking, while other sliders do not include a locking mechanism. When a zipper slider is a locking type of slider, typically the slider includes a locking pin that is inserted into the meshed teeth of the zipper chain such as by lowering a tab onto the zipper slider to lock the slider from moving along the zipper. The user can pull on the tab lifting it away from the zipper slider to remove the locking pin from the meshed teeth of the zipper chain thereby releasing the locking mechanism. The user then can pull on the tab to manually move the zipper slider along the zipper path. In this way, the user can selectively lock a zipper slider at a desired location along the zipper path. An automatically locking zipper slider typically includes a spring that tends to lower the tab to the zipper slider (and thereby inserting the locking pin into the meshed teeth of the zipper chain) when the tab is not being pulled by the user. In this way, the zipper slider automatically self-locks in place when not being manually operated by the user. The use of locking zipper sliders can assist a user to more reliably select and lock in place the selected location of an opening and also more reliably select and lock in place the selected size of the opening on the cover.

Figure 7:
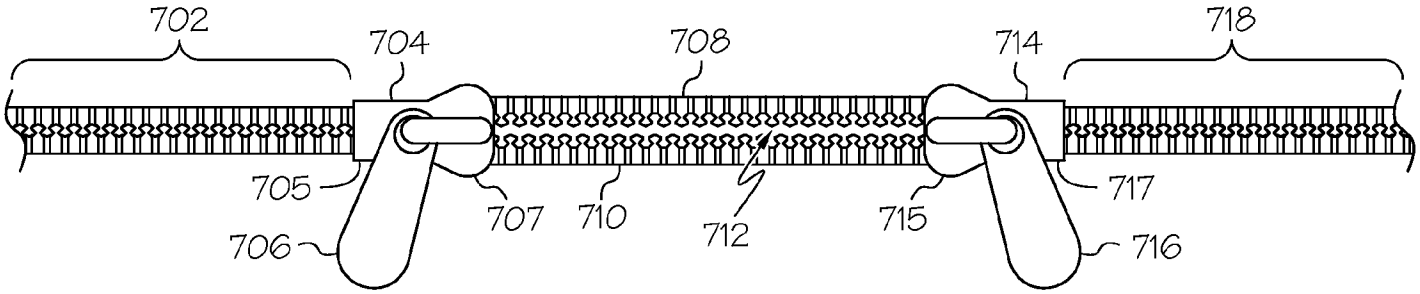
FIG. 7 is an illustration of an example of a zipper, suitable for use with an embodiment according to the present disclosure.

FIG. 7 illustrates an alternative example of a zipper slider arrangement. In this example, a portion of a zipper includes two zipper sliders 704, 714, that are arranged head-to-head on the zipper. That is, the head 707 of a first slider 704 is oriented on the zipper toward the head 715 of the second slider 714.

The tail 705 of the first slider is directed toward a first chain 702 portion of the zipper while the tail 717 portion of the second slider 714 is directed toward a second chain 718 portion of the zipper. The portion of the zipper between the two sliders 704, 714, while the sliders are separated from each other, provides separate opposing rows of teeth 708, 710 in the zipper 406, creating an opening 712. As can be appreciated from FIG. 7 and the description above, the two sliders 704, 714, can be collectively moved along the path of the zipper on the cover to selectively locate an opening 712 on the protective cover. Additionally, the two sliders 704, 714, can be individually moved either away from each other or toward each other along the path of the zipper thereby selectively sizing the opening 712 to a desired size.

It should be noted that pairs of sliders can be arranged and moved along the path of the zipper similar to the two sliders 704, 714, shown in FIG. 7 and discussed above. In this way, a user can select the location and size of each opening created by a pair of sliders. An example of this type of multi-slider arrangement is illustrated in FIGS. 8 and 9.

Figure 8:
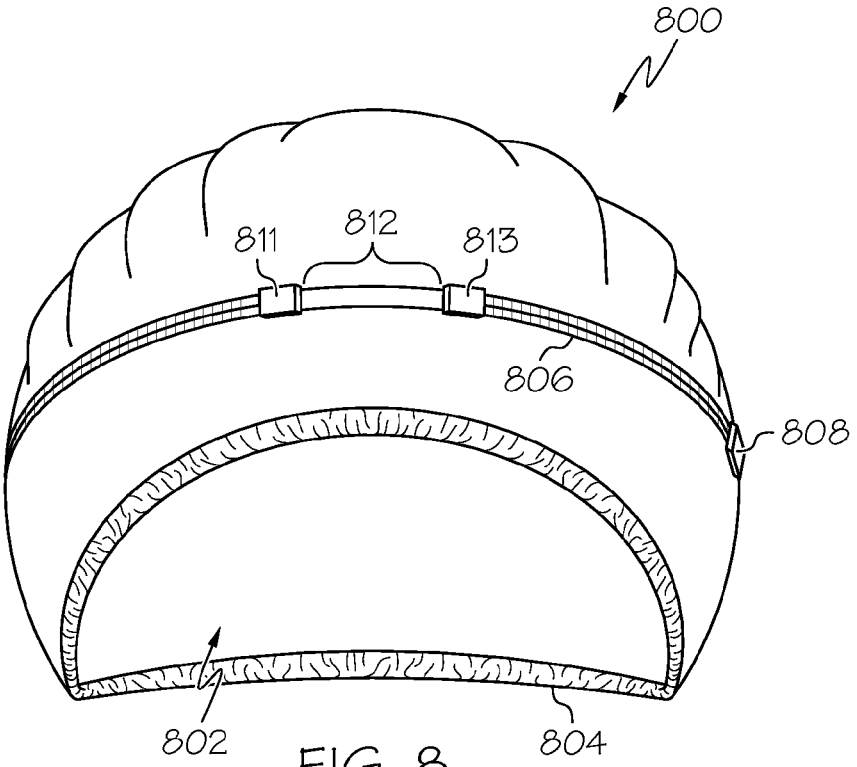
FIG. 8 is a front view of an example of a shower cap, according to the present disclosure
Figure 9:
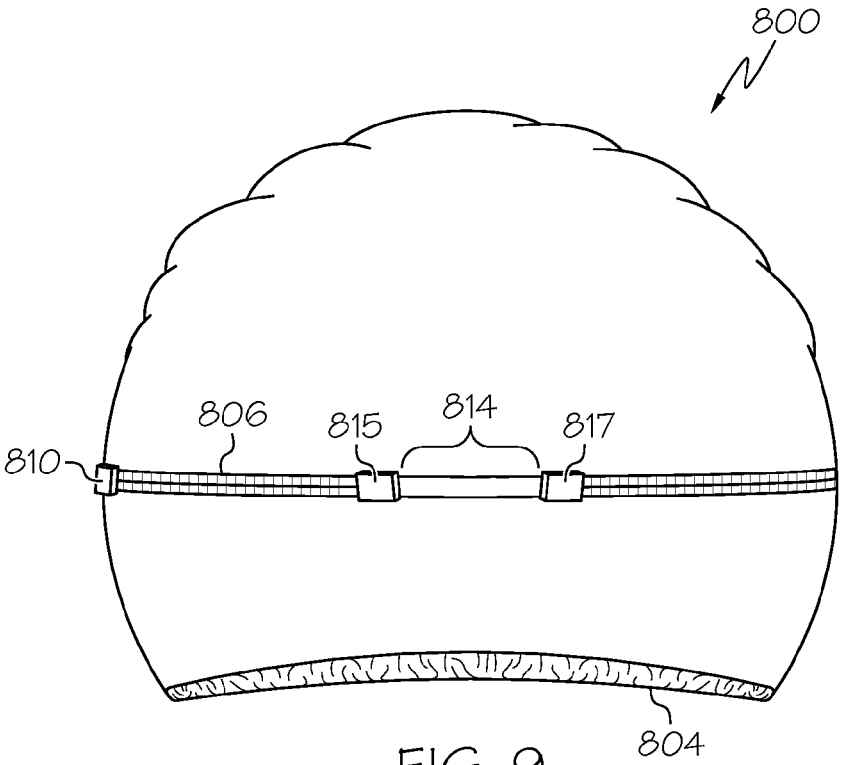
FIG. 9 is a rear view of the example shower cap of FIG. 8.

FIG. 8 shows a front view of a cover 800 and FIG. 9 shows a rear view of the same cover 800. The cover includes an elastic band 804 surrounding a main opening 802. A person can insert their head into the cover 800 through the main opening 804 with the elastic band 804 securing the cover 800 on the person's head. In this example, a first opening 812 is created by a first pair of sliders 811, 813, moving along the path of the zipper 806 while a second opening 814 is created by a second pair of sliders 815, 817, moving along the path of the zipper 806. The path of the zipper 806 extends from a first stop 808 to a second stop 810 on the cover 800, as shown in FIGS. 8 and 9. Therefore, the location and size of each opening 812, 814, can be selected by a user of the cover 800 (i.e., selected from a plurality of selectable locations and from a plurality of selectable sizes) to meet the requirements of particular applications. Portions of hair that are exposed outside of the cover 800 through each of the openings 812, 814, can be contemporaneously exposed to a hair treatment environment, while other hair remains protected under the cover 800.

Figure 10:
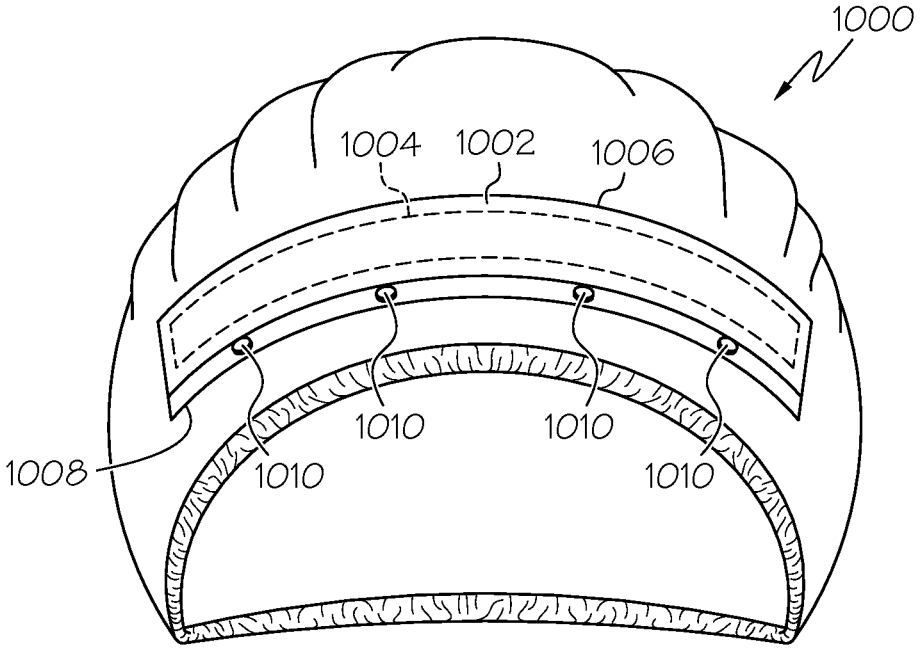
FIG. 10 is a front view of an example of a shower cap, according to an alternative embodiment of the present disclosure
Figure 11:
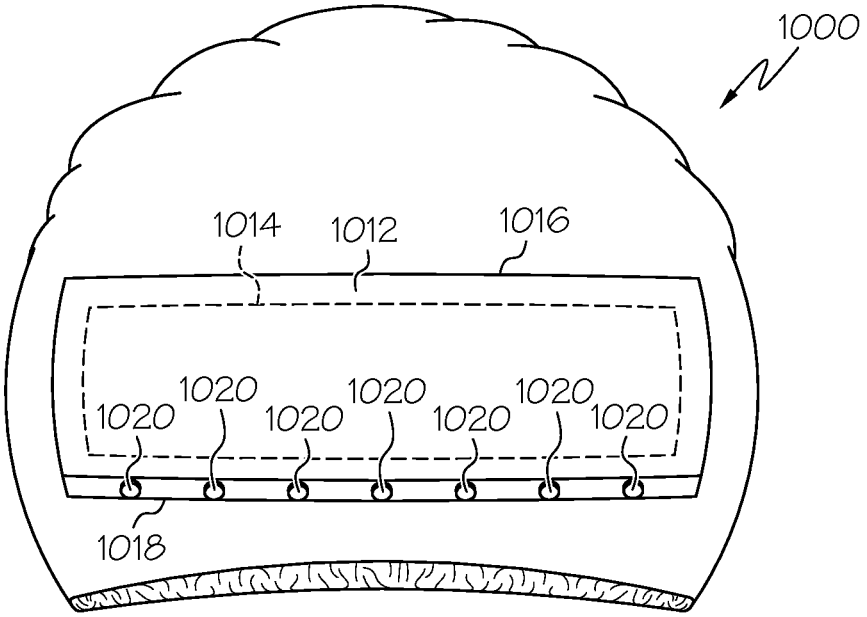
FIG. 11 is a rear view of the example shower cap of FIG. 10.

FIGS. 10 and 11 illustrate a first alternative embodiment of the present disclosure. FIG. 10 shows a front view of an example head cover 1000, while FIG. 11 shows a rear view thereof. The cover 1000 includes a first flap 1002 attached to the front portion of the cover 1000 along a first edge 1006 of the first flap 1002. The cover 1000 also includes a second flap 1012 attached to the rear portion of the cover 1000 along a first edge 1016 of the second flap 1012. The first edge 1006, 1016, of each flap 1002, 1012, can be attached to the cover 1000 in many different ways. For example, and not for limitation, an epoxy adhesive, a glue, or other adhesive or bonding agent, can be used along the length of the first edge 1006, 1016, and attached to the cover 1000. As a second example, the first edge 1006, 1016, of the flap 1002, 1012, could be integrally formed in the cover 1000 and thereby attached. Under each flap 1002, 1012, is a respective opening 1004, 1014, in the cover 1000.

A second edge 1008, 1018, of each flap 1002, 1012, generally opposing the first edge 1006, 1016, on the respective flap 1002, 1012, can be selectively attached to the cover 1000, in this embodiment, by at least one snap 1010, 1020. In the example shown in FIGS. 10 and 11, there are four snaps 1010 located at intervals along the path of the second edge 1008 of the first flap 1002, while there are seven snaps 1020 located at intervals along the path of the second edge 1018 of the second flap 1012. Each snap 1010, 1020, includes a first snap element on the underside of the flap 1002, 1012, and a mating second snap element on the upper side of the cover 1000. The first snap element may be a male snap element and the second snap element may be a mating female snap element, or vice versa. When a snap 1010, 1020, is closed, i.e., the two snap elements of the snap 1010, 1020, are mated together, the particular portion of the respective opening 1004, 1014, about the closed snap is selectively covered and the user's hair under the cover 1000 remains protected from an external hair treatment environment. On the other hand, when a snap 1010, 1020, is open, i.e., the two snap elements of the snap 1010, 1020, are unsnapped and separated from each other. The particular portion of the respective opening 1004, 1014, about the open snap 1010, 1020, is selectively open such that the portion of a user's hair exposed through the particular portion of the opening 1004, 1014, that is open and uncovered will be exposed to an external hair treatment environment, while the user's other hair remains protected under the cover 1000.

As can be appreciated from FIGS. 10 and 11, and the corresponding description above, each of the snaps 1010, 1020, can be opened or closed on the cover 1000 along the path of the second edge 1008, 1018, of the respective flap 1002, 1012. A person (e.g., a user of the cover 1000) can selectively locate at least one opening (i.e., a portion of the opening 1004, 1014, that is exposed by an open snap 1010, 1020) at a location selected from a plurality of selectable locations along the path of the second edge 1008, 1018, of the respective flap 1002, 1012, on the protective cover 1000. Additionally, one or more adjacent snaps 1010, 1020, i.e., adjacent to the selectively located opening, can also be opened thereby selectively sizing the opening (i.e., a portion of the opening 1004, 1014, that is exposed by an open snap 1010, 1020) to a desired size selected from a plurality of selectable sizes.

Figure 12:
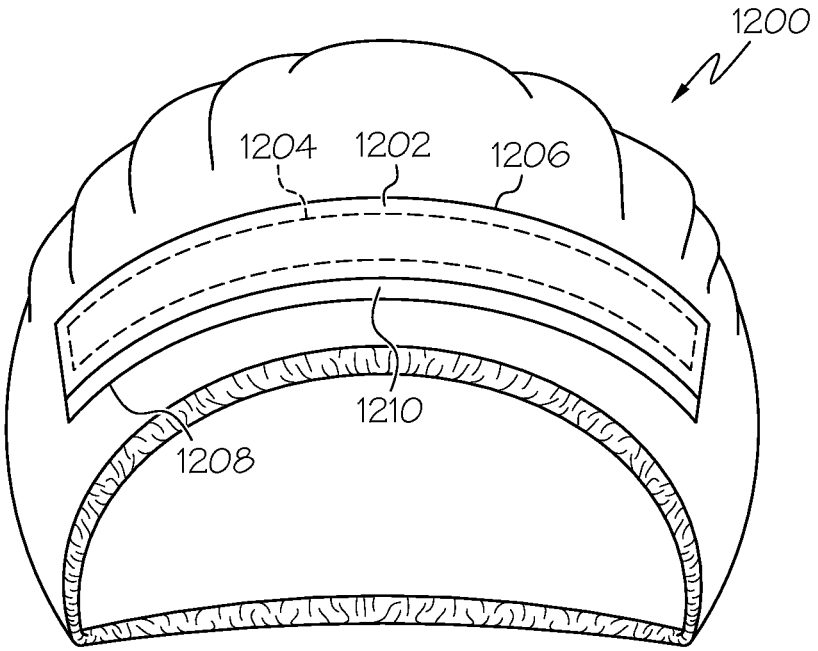
FIG. 12 is a front view of an example of a shower cap, according to another embodiment of the present disclosure.
Figure 13:
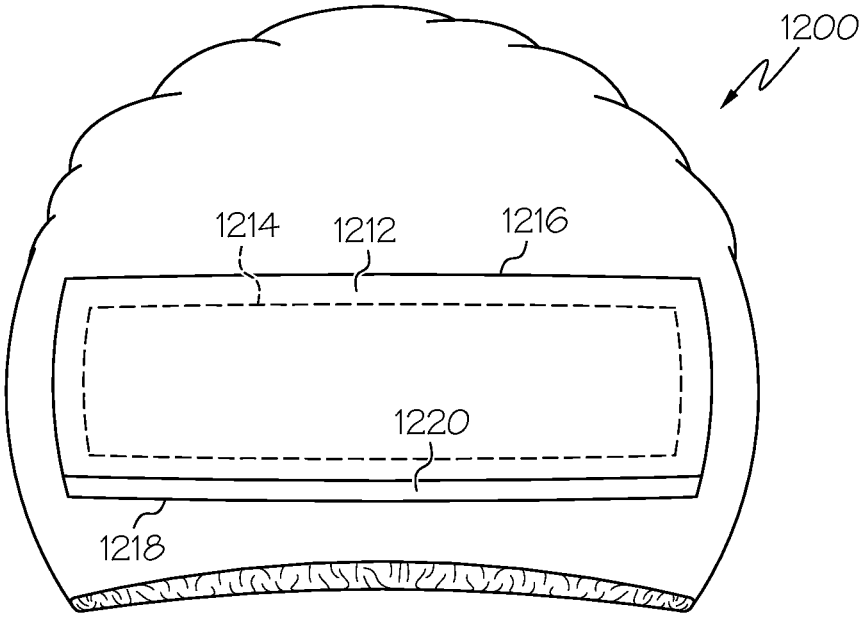
FIG. 13 is a rear view of the example shower cap of FIG. 12.

FIGS. 12 and 13 illustrate a second alternative embodiment of the present disclosure. FIG. 12 shows a front view of an example head cover 1200, while FIG. 13 shows a rear view thereof. The cover 1200 includes a first flap 1202 attached to the front portion of the cover 1200 along a first edge 1206 of the first flap 1202. The cover 1200 also includes a second flap 1212 attached to the rear portion of the cover 1200 along a first edge 1216 of the second flap 1212. The first edge 1206, 1216, of each flap 1202, 1212, can be attached to the cover 1200 in many different ways. For example, an epoxy glue, or other bonding agent, can be used along the length of the first edge 1206, 1216, and attached to the cover 1200. As a second example, the first edge 1206, 1216, of the flap 1202, 1212, could be integrally formed in the cover 1200 and thereby attached. Under each flap 1202, 1212, is a respective opening 1204, 1214, in the cover 1200.

A second edge 1208, 1218, of each flap 1202, 1212, generally opposing the first edge 1206, 1216, on the respective flap 1202, 1212, can be selectively attached to the cover 1200, in this embodiment, by a hook-and-loop strip 1210, 1220. In the example shown in FIGS. 12 and 13, there is a hook-and-loop strip 1210 along the path of the second edge 1208 of the first flap 1202, and there is a hook-and-loop strip 1220 along the path of the second edge 1218 of the second flap 1212. Each hook-and-loop strip 1210, 1220, includes a first hook-and-loop strip element on the underside of the flap 1202, 1212, and a mating second hook-and-loop strip element on the upper side of the cover 1200. The first hook-and-loop strip element may be a hook element and the second hook-and-loop strip element may be a mating loop element, or vice versa. When a portion of the hook-and-loop strip 1210, 1220, is closed, i.e., the two hook-and-loop strip elements of the hook-and-loop strip 1210, 1220, are mated together, the particular portion of the respective opening 1204, 1214, about the closed portion of the hook-and-loop strip is selectively covered and the user's hair under the cover 1200 remains protected from an external hair treatment environment. On the other hand, when a particular portion of the hook-and-loop strip 1210, 1220, is open, i.e., the two hook-and-loop strip elements of the hook-and-loop strip 1210, 1220, are separated from each other, the particular portion of the respective opening 1204, 1214, about the open portion of the hook-and-loop strip 1210, 1220, is selectively open such that the portion of a user's hair exposed through the particular portion of the opening 1204, 1214, that is open and uncovered will be exposed to an external hair treatment environment, while the user's other hair remains protected under the cover 1200.

As can be appreciated from FIGS. 12 and 13, and the corresponding description above, each of the hook-and-loop strip 1210, 1220, can be opened or closed on the cover 1200 along the path of the second edge 1208, 1218, of the respective flap 1202, 1212. A person (e.g., a user of the cover 1200) can selectively locate at least one opening (i.e., a portion of the opening 1204, 1214, that is exposed by an open portion of the hook-and-loop strip 1210, 1220) at a location selected from a plurality of selectable locations along the path of the second edge 1208, 1218, of the respective flap 1202, 1212, on the protective cover 1200. Additionally, one or more adjacent portions of the hook-and-loop strip 1210, 1220, i.e., adjacent to the selectively located opening, can also be opened thereby selectively sizing the opening (i.e., a portion of the opening 1204, 1214, that is exposed by an open hook-and-loop strip 1210, 1220) to a desired size from a plurality of selectable sizes.

The illustrations of examples described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Although specific embodiments have been illustrated and described herein, it should be appreciated that any arrangement calculated to achieve the same purpose may be substituted for the specific embodiments shown. The examples herein are intended to cover any and all adaptations or variations of various embodiments. Combinations of the above embodiments, and other embodiments not specifically described herein, are contemplated herein. For example, a first opening may have selectable location and size on a protective head cover by utilizing a zipper mechanism, as discussed above, and contemporaneously a second opening may have selectable location and size on the protective head cover utilizing a flap with snaps mechanism, as discussed above, or utilizing a flap with hook-and-loop strip mechanism, also as discussed above.

The Abstract is provided with the understanding that it is not intended be used to interpret or limit the scope or meaning of the claims. In addition, in the foregoing Detailed Description, various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The corresponding structures, materials, acts, and equivalents of all means or step plus function elements in the claims below are intended to include any structure, material, or act for performing the function in combination with other claimed elements as specifically claimed. The description herein has been presented for purposes of illustration and description, but is not intended to be exhaustive or limited to the examples in the form disclosed. Many modifications and variations will be apparent to those of ordinary skill in the art without departing from the scope of the examples presented or claimed. The disclosed embodiments were chosen and described in order to explain the principles of the embodiments and the practical application, and to enable others of ordinary skill in the art to understand the various embodiments with various modifications as are suited to the particular use contemplated. It is intended that the appended claims below cover any and all such applications, modifications, and variations within the scope of the embodiments.

What is claimed is:

1. A protective head cover having selectable size and location of at least one opening for exposure of a portion of a user's hair to an external hair treatment environment, comprising:

an impermeable outer surface of the protective head cover that protects hair thereunder from an external hair treatment environment;

a main opening that receives a user's head inserted into the protective head cover; and a plurality of openings on the protective head cover, separate from the main opening, each of the plurality of openings having an opening size that is selectable from a plurality of selectable sizes and having an opening location that is selectable from a plurality of selectable locations on the protective head cover, thereby selectively exposing through at least one opening of the plurality of openings a portion of the user's hair from under the protective head cover to an external hair treatment environment while protecting another portion of the user's hair, that is covered under the protective head cover, from the external hair treatment environment.

2. The protective head cover of claim 1, further comprising:

a securing head band mechanically coupled to at least a portion of a perimeter of the main opening for securing the protective head cover to a user's head.

3. The protective head cover of claim 2, wherein the securing head band comprises an elastic band.

4. The protective head cover of claim 1, wherein the at least one opening on the protective head cover comprises at least one zipper with at least one zipper slider arranged moveable along the at least one zipper thereby selecting a location from a plurality of selectable locations for the particular at least one opening along the path of the at least one zipper on the protective head cover, and the at least one zipper slider also being arranged movable along the at least one zipper thereby selecting a size from a plurality of selectable sizes for the particular at least one opening along the path of the at least one zipper on the protective head cover.

5. The protective head cover of claim 1, wherein the at least one opening on the protective head cover has a selectable location from a plurality of selectable locations for the at least one opening extending along a path that is generally horizontally oriented on the protective head cover around the user's head when the protective head cover is worn on the user's head.

6. The protective head cover of claim 1, wherein the external hair treatment environment comprises at least one of a hair washing environment and a hair coloring environment, and wherein the at least one opening on the protective head cover exposing the particular portion of a user's hair to the at least one hair washing environment and hair coloring environment, while the protective head cover protecting another portion of the user's hair, that is under the protective head cover, from the at least one hair washing environment and hair coloring environment.

7. A protective head cover having selectable size and location of at least one opening for exposure of a portion of a user's hair to an external hair treatment environment, comprising:

an impermeable outer surface of the protective head cover that protects hair thereunder from an external hair treatment environment;

a main opening that receives a user's head inserted into the protective head cover; and at least one opening on the protective head cover, separate from the main opening, the at least one opening having an opening size that is selectable from a plurality of selectable sizes for the at least one opening and having an opening location that is selectable from a plurality of selectable locations for the at least one opening on the protective head cover, thereby selectively exposing through the at least one opening a portion of the user's hair from under the protective head cover to an external hair treatment environment while protecting another portion of the user's hair, that is covered under the protective head cover, from the external hair treatment environment; and wherein the at least one opening on the protective head cover comprises a plurality of openings on the protective head cover, each of a first opening of the plurality of openings and a second opening of the plurality of openings having an opening size that is selectable from a plurality of selectable sizes for the particular each of the first opening and the second opening, and having an opening location that is selectable from a plurality of selectable locations for the particular each of the first opening and the second opening on the protective head cover.

8. The protective head cover of claim 7, wherein at least one of the first opening and the second opening comprises:

a zipper with two zipper sliders arranged head-to-head such that the two zipper sliders are collectively moveable along the zipper thereby selecting a location from a plurality of selectable locations for the particular at least one of the first opening and the second opening on the protective head cover, and the two zipper sliders can be separated from each other a desired length along the zipper thereby selecting a size from a plurality of selectable sizes for the particular at least one of the first opening and the second opening on the protective head cover.

9. The protective head cover of claim 8, wherein at least one of the two zipper sliders comprises a locking zipper slider.

10. The protective head cover of claim 7, wherein each of both the first opening and the second opening comprises:

a zipper with two zipper sliders arranged head-to-head such that the two zipper sliders are collectively moveable along the zipper thereby selecting a location from a plurality of selectable locations for the respective each of the first opening and the second opening on the protective head cover, and the two zipper sliders can be separated from each other a desired length along the zipper thereby selecting a size from a plurality of selectable sizes for the respective each of the first opening and the second opening on the protective head cover.

11. The protective head cover of claim 10, wherein at least one of the two zipper sliders comprises a locking zipper slider.

12. A protective head cover having selectable size and location for each of a plurality of openings for exposure of a portion of a user's hair to an external hair treatment environment, comprising:

an impermeable outer surface of the protective head cover that protects hair thereunder from an external hair treatment environment;

a main opening that receives a user's head inserted into the protective head cover; and a plurality of openings on the protective head cover, separate from the main opening, each of the plurality of openings having an opening size that is selectable from a plurality of selectable sizes for the each opening and having an opening location that is selectable from a plurality of selectable locations for the each opening on the protective head cover along a path extending generally horizontally on the protective head cover, thereby selectively exposing through the each opening a portion of the user's hair from under the protective head cover to an external hair treatment environment while the protective head cover protecting another portion of the user's hair, that is covered by the protective hair cover, from the external hair treatment environment.

13. The protective head cover of claim 12, wherein a first opening of the plurality of openings on the protective head cover is located about a location on the front of the protective head cover while the protective head cover is worn on a user's head, and wherein contemporaneously a second opening of the plurality of openings on the protective head cover is located about a location on the rear of the protective head cover, portions of a user's hair can be contemporaneously exposed through the first opening and the second opening to the external hair treatment environment while other of the user's hair remains protected under the protective head cover.

14. The protective head cover of claim 12, wherein the plurality of openings on the protective head cover comprises a first opening and a second opening, separate from the first opening, and wherein the external hair treatment environment comprises a hair washing environment, and wherein the first opening and the second opening on the protective head cover contemporaneously exposing respective portions of a user's hair to the hair washing environment while the protective head cover protecting another portion of the user's hair, that is under the protective head cover, from the hair washing environment.

15. The protective head cover of claim 12, wherein the plurality of openings on the protective head cover comprises a first opening and a second opening, separate from the first opening, and wherein the external hair treatment environment comprises a hair coloring environment, and wherein the first opening and the second opening on the protective head cover exposing respective portions of a user's hair to the hair coloring environment while the protective head cover protecting another portion of the user's hair from the hair coloring environment.

* * * * *